US006280109B1

(12) United States Patent
Serratore

(10) Patent No.: US 6,280,109 B1
(45) Date of Patent: Aug. 28, 2001

(54) MARKER FOR WIRE CASINGS

(76) Inventor: Vincent J. Serratore, 802 S. Osage St., Papillion, NE (US) 68046

( * ) Notice: Subject to any disclaimer, the term of this patent is extended or adjusted under 35 U.S.C. 154(b) by 0 days.

(21) Appl. No.: 09/760,598

(22) Filed: Jan. 15, 2001

(51) Int. Cl.[7] ..... A46B 11/00
(52) U.S. Cl. ..... 401/11; 401/9; 401/198
(58) Field of Search ..... 401/11, 9, 10, 401/196, 198, 199, 35; 118/78, 208, DIG. 21, DIG. 22

(56) References Cited

U.S. PATENT DOCUMENTS

| | | | | |
|---|---|---|---|---|
| 2,095,650 | | 10/1937 | Reichenbach | 131/55 |
| 2,101,132 | | 12/1937 | Daly et al. | 132/1 |
| 2,408,481 | | 10/1946 | Reid | 91/62.5 |
| 2,930,061 | | 3/1960 | O'Neil | 15/131.05 |
| 3,352,623 | * | 11/1967 | Sanet | 401/10 |
| 4,254,645 | * | 3/1981 | Kouris | 401/9 |
| 4,723,859 | * | 2/1988 | Kitoh | 401/35 |
| 4,770,557 | | 9/1988 | Pitts | 401/193 |
| 4,821,748 | * | 4/1989 | Reas | 401/9 |
| 5,071,276 | | 12/1991 | Nielsen et al. | 401/9 |
| 5,820,285 | * | 10/1998 | Ikeda et al. | 401/199 |
| 5,954,443 | | 9/1999 | Bacon | 401/192 |

* cited by examiner

*Primary Examiner*—David J. Walczak
(74) *Attorney, Agent, or Firm*—Koley Jessen P.C. A Limited Liability Organization; Mark D. Frederiksen

(57) ABSTRACT

A marker includes an enclosed housing with a marker tip of a marking element projecting from an open end of the housing. An aperture is formed through the marking tip, through which a wire may be journaled to mark the entire perimeter surface of the wire as the wire is pulled through the aperture.

5 Claims, 1 Drawing Sheet

MARKER FOR WIRE CASINGS

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to markers for marking the external surface of a wire strand casing, and more particularly to an improved marker for simultaneously marking the entire perimeter surface of a cylindrical strand of material.

(2) Background Information

In wiring residential dwellings, several wire strands will terminate within an electrical box. The electrical box may be the location for an outlet, a switch, or other electrical device. Because residential dwellings are wired with conventional wire of the variety including a black casing, a white casing, and a bare ground wire, it often occurs at electrical boxes that several white wires terminate within a single box.

The national electrical code requires that the terminal end of any wire at an electrical box which is a "hot" wire, must be permanently marked with black ink along the terminal end of the casing. In this way, an electrician adding a particular electrical device, such as a switch or outlet, will know which wires are "hot" and which wires are "neutral".

In the prior art, the terminal ends of the wire are conventional marked with a black marker, requiring the flat tip of the marker to be run longitudinally along the length of the terminal end of the casing around all sides until the entire perimeter of the casing is permanently marked. While this task is not difficult, it is tedious and time consuming, when it is considered the number of boxes and terminal wire ends which commonly occur in a conventional residential dwelling.

If the wires are improperly marked, they are "red tagged" by an inspector, and require the electrician to return to the job site and complete the task of marking the terminal wires.

The same problem exists in other types of strand-like material, such as tubing or rope. For example, in the medical industry the use of intravenous (IV) solution delivery systems may require multiple IVs connected between a patient and multiple fluid sources.

One solution found in the prior art is the manufacture of a colored stripe directly in the product. This practice has been found both in the electrical industry and in the flexible tubing industry. However, the cost of manufacturing a product with a permanent stripe requires the modification of existing equipment, or the purchase of entirely new equipment, adding significantly to the cost of manufacture. Additionally, it would require an electrician to carry yet another type of wire along on every job. If multiple different strands are necessary, the user must maintain an extensive inventory of strands of a wide variety of different colored stripes.

U.S. Pat. No 5,954,443 to Bacon discloses an apparatus for marking a strand of material including a guide notch for directing the strand material against a marking nib. In one version of this invention, a notch is cut directly into the nib to guide the strand material along the marking nib. While this patent improves the reliability of marking the strand material, it still requires numerous passes along the length of the strand to mark the entire perimeter casing of the strand.

Similarly, the lubricant applicator disclosed in U.S. Pat. No. 2,930,061 discloses an arcuate shoe member with a curvature matching that of a cylindrical rod to be lubricated. Again, in order to lubricate the entire perimeter surface of the rod, either the rod must be rotated on its axis, and the lubricator moved the length of the rod a plurality of times to coat the entire length of the rod.

BRIEF SUMMARY OF THE INVENTION

It is therefore a general object of the present invention to provide an improved marker for wire casings for quickly and easily marking the entire perimeter of the wire casing.

Another object of the present invention is to provide a marker which will mark the entire perimeter of a wire casing in a single pass.

A further object is to provide a marker for wire casings which is economical to manufacture, and simple to use.

These and other objects of the present invention will be apparent to those skilled in the art.

The marker of the present invention includes an enclosed housing with a marker tip of a marking element projecting from an open end of the housing. An aperture is formed through the marking tip, through which a wire may be journaled to mark the entire perimeter surface of the wire as the wire is pulled through the aperture.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
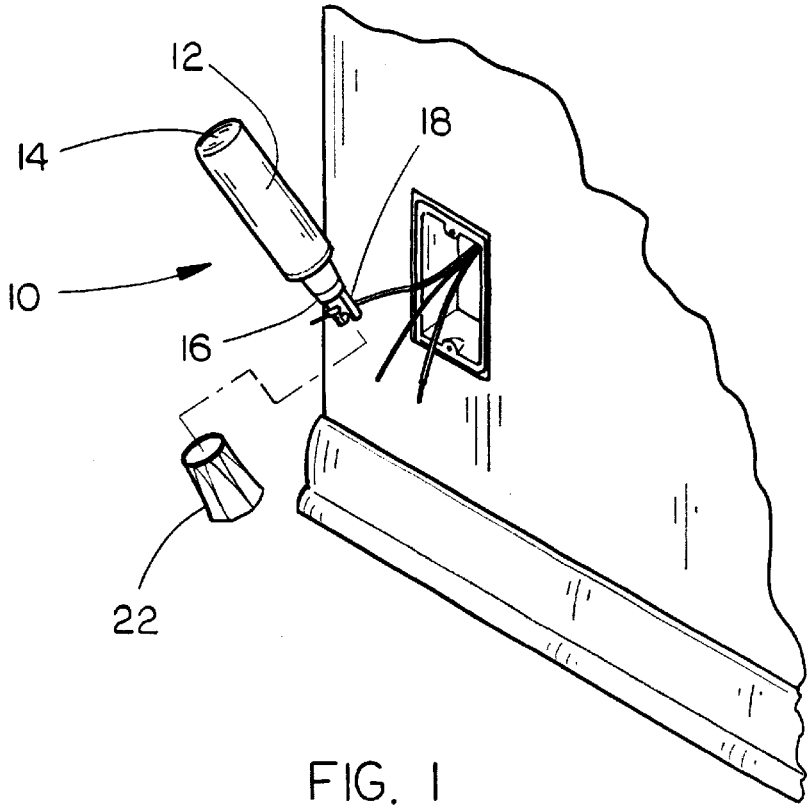
FIG. 1 is a pictorial view of the marker with a marker cap removed and being utilized to mark a wire.
Figure 2:
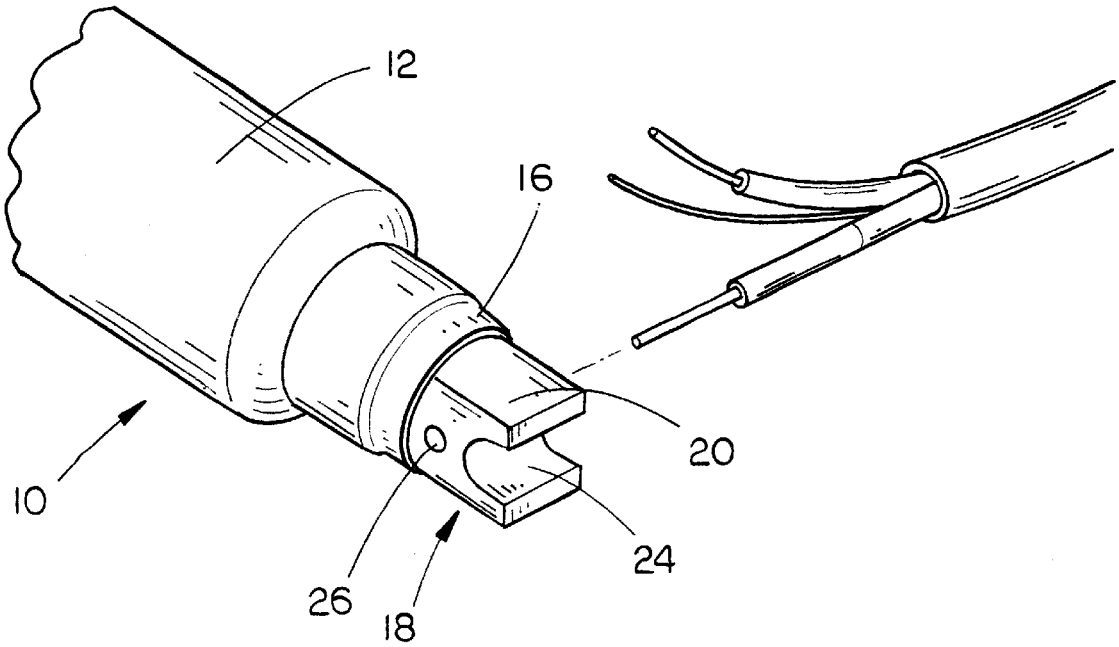
FIG. 2 is an enlarged perspective view of the marker with a wire positioned for marking.

Referring now to the drawings, the marker of the present invention is designated generally at 10 and includes a generally cylindrical housing 12 having a closed bottom 14 and an open upper end 16. Housing 12 serves as a reservoir for a marker medium such as ink, dye, paint, or any other substance suitable for marking the intended surface. The marking medium may be any desired color for the particular application for that marker.

The reservoir can be of any conventional variety designed to store marking medium, including porous material, a bladder, or a sealed compartment. A nib 18 projects outwardly from the housing upper end 16 for applying the marking medium to an object. Nib 18 extends into the interior housing 12 and into the reservoir. Nib 18 may be of any conventional marking material such as felt, open cell foam, or related materials which will wick the marking medium from the reservoir to the marking tip, designated generally at 20 of the nib 18.

A cap 22 is preferably formed in the shape of a hollow tubular member, and is designed to connect to housing 12 and seal marking tip 20 within the interior of cap 22. This sealed attachment prevents marking tip 20 from drying out from exposure to the air.

Nib 18 is preferably rectangular in cross-section at the marking tip 20. A generally semi-cylindrical notch 24 is formed in the end of marking tip 20. Notch 24 serves to follow the outer perimeter of larger wires, with the curved surface of notch 24 applying the marking medium to a greater extent of the wire casing than a flat surface found in conventional markers.

A tubular aperture 26 extends transversely through the thickness of nib 18 in marking tip 20, and preferably has a diameter of approximately ⅛". Aperture 26 is sized to permit a wire with casing of approximately No. 12 or smaller in diameter to be pushed through the aperture 26 with the entire perimeter surface of the casing in contact with the nib 18 as it is pushed through the aperture 26. Thus, the entire surface of the wire casing is marked with marking medium with a single pass of the wire and casing through aperture 26.

A user can quickly mark the entire perimeter surface of a small wire casing by journaling the wire through the aperture and then removing the wire back out of the aperture 26 of marker 10. The marked casing will change the color of the entire surface of the casing as desired by the user, with a single pass of the marker. For larger diameter strand members, the strand may be passed through notch 24. While more than one pass is required to coat the entire perimeter surface, the curved shaped of the notch reduces the number of passes required to coat the entire perimeter surface, when compared to a flat tipped marker.

Whereas the invention has been shown and described in connection with the preferred embodiment thereof, many modifications, substitutions and additions may be made which are within the intended broad scope of the appended claims.

What is claimed is:

1. A marker, comprising:

an enclosed housing with an open end, said housing containing fluid marking medium therein;

a marking element extending through the housing open end and into the marking medium, said marking element having a marking tip projecting from the housing open end;

said marking element being formed of a fibrous material which wicks the marking medium;

the marking tip having a generally cylindrical aperture formed therethrough for marking all of a perimeter surface of a strand of material as the strand is passed through the aperture;

said aperture being oriented generally transversely to a longitudinal axis of the housing, and having a diameter of approximately ⅛";

said tip including a generally semi-cylindrical notch formed in an end thereof with a radius greater than the radius of the aperture.

2. A marker, comprising:

an enclosed housing with an open end, said housing containing fluid marking medium therein;

a marking element extending through the housing open end and into the marking medium, said marking element having a marking tip projecting from the housing open end;

said marking element being formed of a fibrous material which wicks the marking medium;

the marking tip having a generally cylindrical aperture formed therethrough for marking all of a perimeter surface of a strand of material as the strand is passed through the aperture;

said aperture being oriented generally transversely to a longitudinal axis of the housing;

said tip including a generally semi-cylindrical notch formed in an end thereof with a radius greater than the radius of the aperture.

3. A marker, comprising:

an enclosed housing with an open end, said housing containing fluid marking medium therein;

a marking element extending through the housing open end and into the marking medium, said marking element having a marking tip projecting from the housing open end;

said marking element being formed of a fibrous material which wicks the marking medium;

the marking tip having a generally cylindrical aperture formed therethrough for marking all of a perimeter surface of a strand of material as the strand is passed through the aperture;

said aperture being oriented generally transversely to a longitudinal axis of the housing;

said tip including a generally semi-cylindrical notch formed in an end thereof with a surface for marking a perimeter surface of a strand of material.

4. A marker, comprising:

an enclosed housing with an open end, said housing containing fluid marking medium therein;

a marking element extending through the housing open end and into the marking medium, said marking element having a marking tip projecting from the housing open end;

said marking element being formed of a fibrous material which wicks the marking medium;

the marking tip having a generally cylindrical aperture formed therethrough for marking all of a perimeter surface of a strand of material as the strand is passed through the aperture;

said aperture being oriented generally transversely to a longitudinal axis of the housing;

said tip including a notch formed in an end thereof with a surface for marking a perimeter surface of a strand of material.

5. The marker of claim 4 wherein said notch surface is curved to generally follow a perimeter surface of a strand of material.

* * * * *